United States Patent [19]

McDermott

[11] 4,008,015

[45] Feb. 15, 1977

[54] ROTOR-STATOR GEAR SET

[75] Inventor: Hugh L. McDermott, Minneapolis, Minn.

[73] Assignee: Eaton Corporation, Cleveland, Ohio

[22] Filed: Nov. 3, 1975

[21] Appl. No.: 628,273

[52] U.S. Cl. ..... 418/61 B; 418/171; 418/178; 74/465; 74/804

[51] Int. Cl.[2] ..... F01C 1/02; F03C 3/00; F04C 1/02; F16H 55/10

[58] Field of Search ..... 418/61 B, 125, 166, 418/171, 178, 225; 74/465, 804, 805

[56] References Cited

UNITED STATES PATENTS

| | | | |
|---|---|---|---|
| 2,465,595 | 3/1949 | Kratzer | 418/225 |
| 2,790,394 | 4/1957 | Mori | 418/225 |
| 3,460,481 | 8/1969 | White | 418/178 |
| 3,591,320 | 7/1971 | Woodling | 418/61 B |
| 3,915,603 | 10/1975 | Swedberg | 418/61 B |

*Primary Examiner*—John J. Vrablik
*Attorney, Agent, or Firm*—Teagno & Toddy

[57] ABSTRACT

A stator-rotor assembly wherein rollers are used to form the internal teeth of the stator. The rotor has one less tooth than the stator and cooperates in gear relationship with the internal teeth of the stator. The stator has a plurality of cylindrically shaped pockets each containing a cylindrical roller. Each pocket is covered with a crushable porous coating to a thickness of X units. The radius of the pocket is R units and the radius of the rollers is equal to or greater than R-X units and less than R units. Each roller crushes the coating at spaced locations to trap fluid between the rollers and the pocket. The rotor has an average diameter that interferes with the tangent circle of the stator-roller assembly.

15 Claims, 5 Drawing Figures

ROTOR-STATOR GEAR SET

This invention relates to fluid pressure devices, including pumps, motors, and valves having relatively movable internally and externally toothed members.

Hydraulic devices of the above-referred to type are useful in a variety of applications where low speed and high torque are required. These devices comprise an internally toothed member (stator) and an externally toothed member (rotor) which is positioned eccentrically within the stator. The stator generally has one more tooth than the rotor. As the stator and rotor are rotated relative to one another, the rotor moved hypocycloidally relatively to the axis of the stator to form alternately expanding and contracting chambers between each pair of adjacent teeth of the stator and each tooth of the rotor.

To maintain volumetric efficiency within such devices, leakage between chambers at high pressure and those at low pressure must be minimized. Thus the fit between mating teeth is critical and the teeth of the rotor must be precisely formed to provide an accurate fit with the teeth of the stator. Teeth wear, however, can increase the clearance between the rotor and stator causing leakage with resultant inefficiency of the device occuring.

The prior art has attempted to overcome the problems associated with the close fit between the stator and rotor by forming the teeth of the stator from cylindrical rollers rotatably positioned in cylindrically shaped pockets formed in the stator. Known devices utilizing rollers as the teeth of the stator may be distinguished by the relationship between the roller diameter and pocket diameter, as well as by the relationship between the "tangent circle" of the stator-roller assembly (i.e., a circle tangent to the inner peripheries of the rollers centered within their respective pockets) and the "average diameter" of the rotor (i.e., the average of the major and minor diameters of the rotor).

Thus, a device is referred to as having an "interference fit" when each of the rollers has substantially a "bearing fit" with its respective pocket (i.e., a diametral clearance between the roller and pocket greater than zero and less than about 0.0015 inches (0.038 mm)), and the average diameter of the rotor "interferes" with the tangent circle of the stator-roller assembly (i.e., the average diameter is larger than the tangent circle by as much as about 0.0010 inches (0.025 mm), or more). In such devices, the interference fit precludes any inward radial movement of the rollers.

A device is referred to as having a "non-interference fit" when each roller has a bearing fit with its respective pocket and there is a clearance between the average diameter of the rotor and the tangent circle of the stator-roller assembly (i.e., the average diameter is dimensionally smaller than the tangent circle by about 0.0010 inches (0.025 mm), or more). In such devices, inward radial movement of the rollers is possible because of the clearance between the average diameter and the tangent circle.

A device is referred to as having a "loose fit" when each roller and respective pocket has more diametral clearance than a bearing fit and there is a clearance between generally average diameter of the rotor and the tangent circle of the stator-roller assembly. The pockets in these devices are generaly configured to develop a controlled, essentially hydrostatic, pressure pattern biasing the roller inwardly toward the corresponding rotor tooth when the roller is positioned between chambers at high and low pressures. These pressure patterns are generally characterized by being symmetrically distributed over a portion of the pocket and are intended to produce a controlled, resultant force directed radially-inwardly and of sufficient magnitude to adequately seal high pressure chambers from low pressure chambers. Additionally, the roller support surfaces maintain the rollers in their proper geometric relationship even through the recesses provide an "excessive clearance" necessary to establish the intended biasing force.

It is applicant's belief that even in view of the foregoing arrangements in certain applications adequate sealing over an extended period of use of the device is not accomplished. It is, therefore, an object of the invention to provide an improved arrangement to hold the cylindrical rollers in the cylindrically shaped pockets in a manner which will result in improved life of the rollers and adequate sealing between the rotor teeth and the rollers.

The above object is accomplished by providing cylindrically shaped pockets, each having a radius which is slightly larger than the radius of the roller which is to be located therein and by providing a crushable porous coating on the wall of each pocket having a thickness which will reduce the dimensions of the respective pocket making the radius of the pocket equal to or slightly less than the radius of the roller to be located therein. This will accordingly require the roller to be forced into the pocket sealing the pocket at the edges and retaining a quantity of fluid between the roller and the wall of the pocket. Such an arrangement will result in an increase in the viscosity of the oil trapped between the roller and the pocket as the roller is forced into the pocket thereby improving the lubrication characteristic of the fluid and allowing for better rotation of the roller within the pocket. By combining this roller-pocket concept with a rotor having an average diameter that interferes with the tangent circle of the stator-roller assembly contact will be made between the teeth of the rotor and the roller causing the roller to rotate during such contact within the respective pocket while simultaneously forming a seal which prevents fluid from flowing between the teeth of the rotor and the roller.

Figure 2:
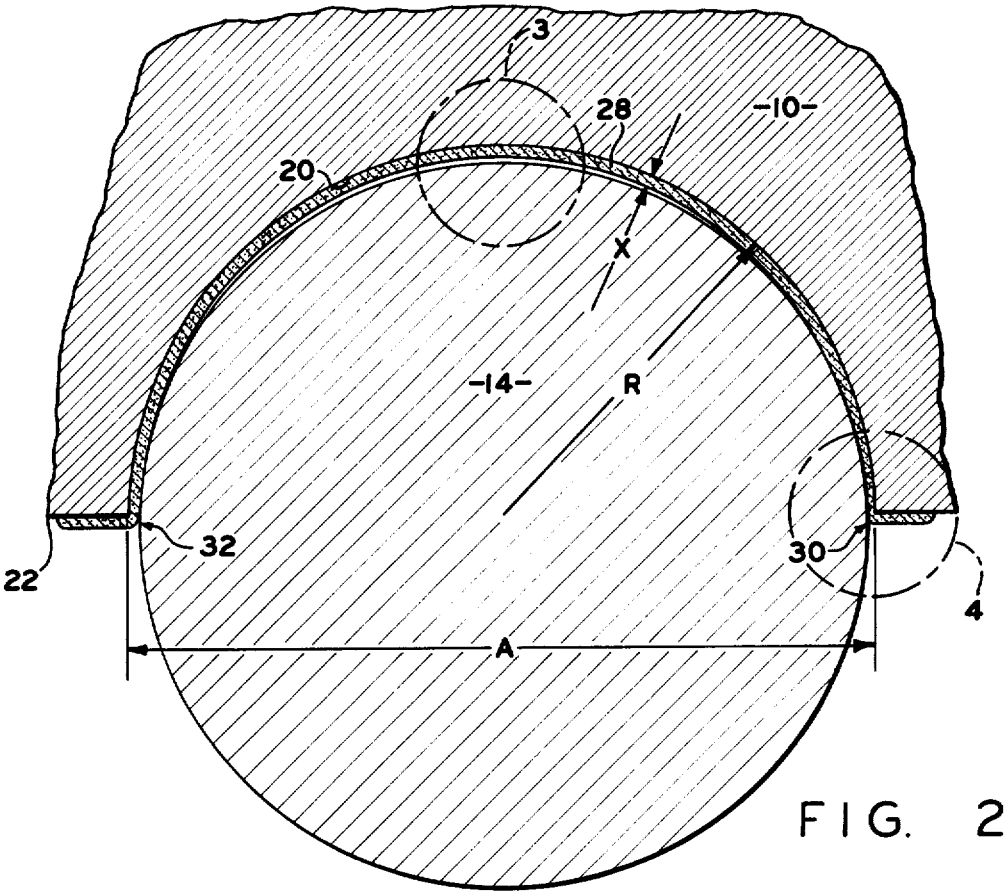
FIG. 2 is an enlarged view of a portion of FIG. 1.
Figure 3:
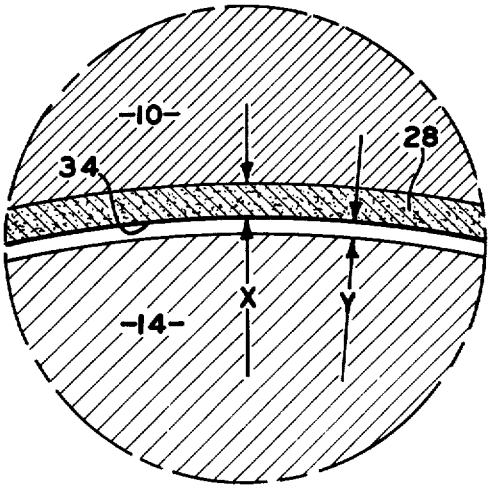
Figure 4:
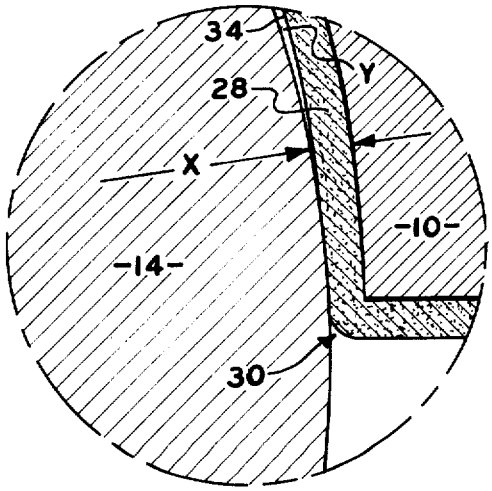

FIGS. 3 and 4 are enlarged views of portions 3 and 4 respectively of FIG. 2.

Figure 1:
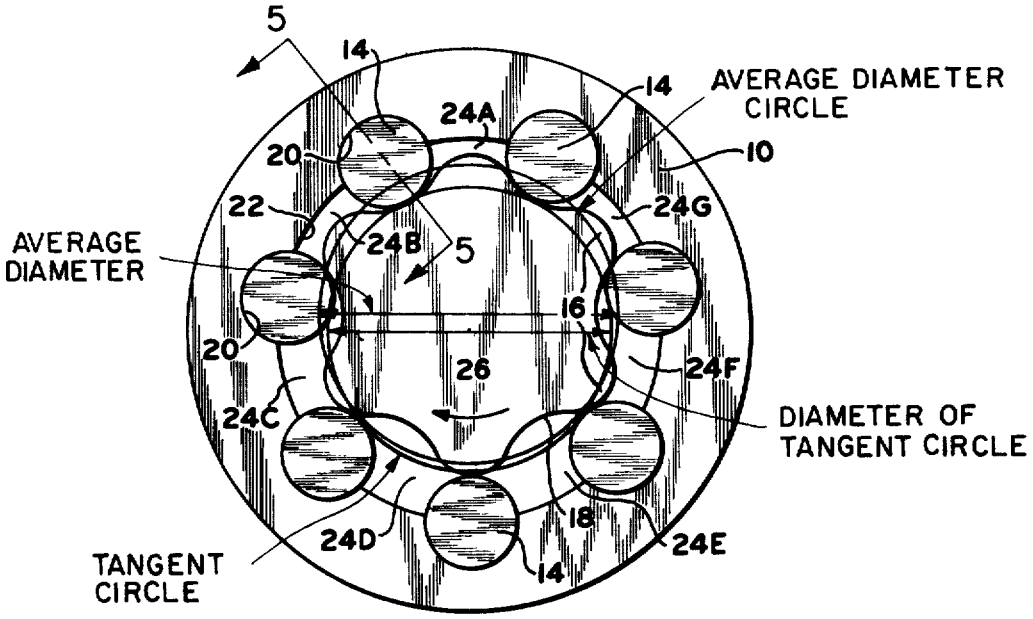
FIG. 1 is an elevational view of the stator-rotor assembly.
Figure 5:
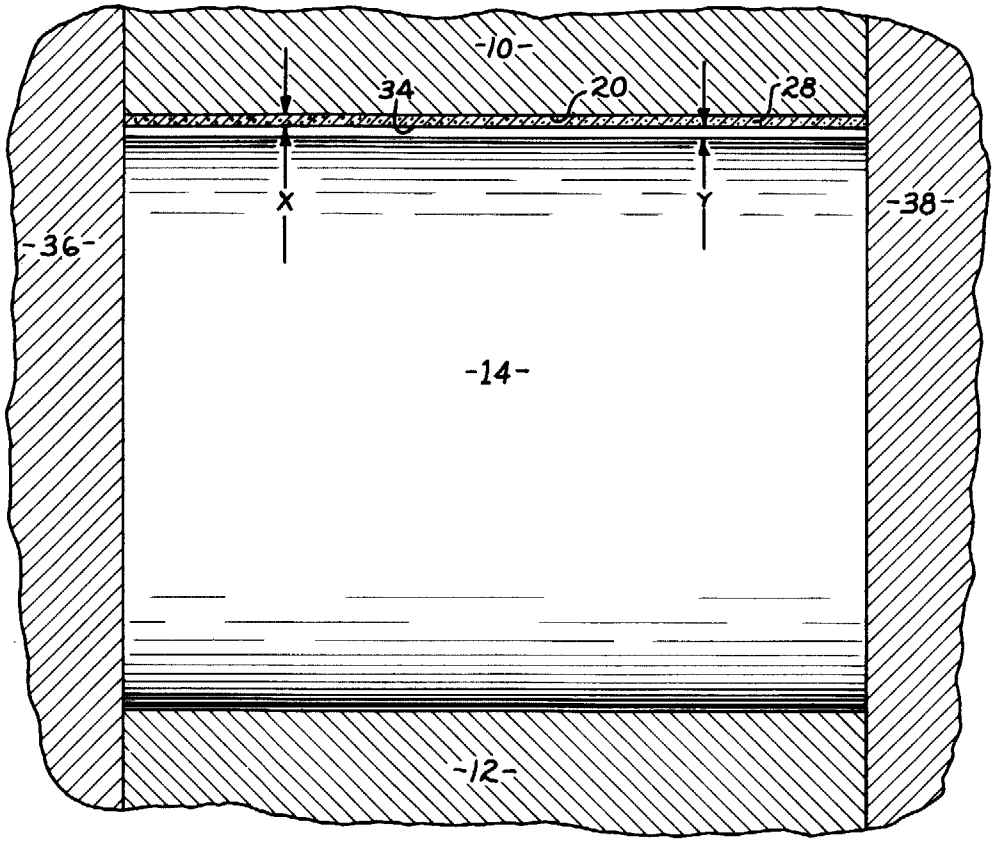

FIG. 5 is an enlarged view taken substantially along lines 5—5 in FIG. 1.

FIG. 1 illustrates an internally toothed annularly shaped member (stator) 10 and an externally toothed member (rotor) 12. The number of teeth 14 on stator 10 is preferably one more than the number of teeth 16 on rotor 12.

Rotor teeth 16 comprise convexly shaped portions angularly spaced about a central axis of rotor 12 and separated by concavely shaped portions 18. Stator teeth 14 comprise a plurality of angularly spaced cylindrical rollers which are housed in a corresponding plurality of cylindrically shaped walls 20 forming pockets opening into an inner peripheral wall 22 of stator 10. The rotor has an average diameter that "interferes" with the tangent circle of the stator-roller assembly.

For the purpose of the remainder of the specification and claims the word interferes as it relates to the stator-rotor relationship shall mean that the diametrical interference of the average diameter of the rotor with the tangent circle of the stator assembly is 0.002 to 0.02 percent of the diameter of the tangent circle.

The axis of rotor 12 is eccentrically disposed with respect to the central axis of stator 10. As rotor 12 is rotated relative to stator 10, rotor teeth 16 mesh with stator teeth 14 to impart a hypocycloidal path of movement to rotor 12 whereby the rotor orbits about the central axis of the stator 6 times, corresponding to the number of teeth of rotor 12, for each revolution of the rotor.

During hypocycloidal movement of rotor 12, rotor teeth 16 form, in combination with stator teeth 14 and inner peripheral wall 22 of stator 10, alternately expanding and contracting fluid chambers indicated respectively at 24A through 24G. As illustrated, chamber 24B is approaching its minimum volume, chambers 24C and 24D are being contracted, and chambers 24E, 24F, and 24G are expanding. Further rotation of rotor 12 in the direction of arrow 26 will have the effect of expanding chamber 24A.

When the stator-rotor assembly is being utilized in a fluid motor, means are provided for communicating the expanding fluid chambers to a source of pressurized fluid and the contracting chambers to a discharge. When the stator-rotor assembly is being utilized in a pump or valve, the expanding chambers are placed in communication with a fluid inlet and the contracting chambers are placed in communication with a discharge. Suitable means for communicating the fluid chambers alternately and successively are known in the art as, for example, disclosed by L. L. Charlson in U.S. Pat. No. Re. 25,291.

Although rotor 12 is described herein as being rotatable within and orbitally movable relative to stator 10, either the rotor or the stator can be fixed. Furthermore, either the rotor of stator can be arranged to rotate only while the other one orbits only.

As illustrated in FIG. 2, each pocket formed by wall 20 has a radius of R units. Each wall 20 preferably covers an arc of approximately 180°. However, as will be hereinafter explained, the arc may be less than or greater than 180°. The wall of each pocket is coated with a crushable porous material 28, such as iron manganese phosphate (commonly referred to in the trade as "Parker Lubrite No. 2"), to a thickness of X units. Material 28 of the coating may extend beyond the wall 20 of the pocket onto inner peripheral wall 22 of stator 10. It is desirable to maintain thickness X of the crushable porous material 28 as constant as possible throughout the length of wall 20. In a typical application, thickness X will be between 0.0001 inches (0.0025 mm) to 0.0031 inches (0.079 mm) where the radius of wall 20 is in the range from 0.05 inches (1.27 mm) to 3.0 inches (76.2 mm). The thickness of the coating can be relatively thin due to the ease of manufacturing walls 20 and the superior lubrication provided which greatly reduces wear of the pockets.

Across the opening of the pocket formed by each wall 20 lies a distance which is equivalent to chord A (FIG. 2). The radius of each roller should be equal to or greater than R-X and less than R. Further, chord A must be greater than the diameter of the roller if the arc of wall 20 is greater than 180 degrees. A normal range of operation could be set forth as making the arc of wall 20 between 150 degrees and 185 degrees. In this manner, when the roller is located within its respective pocket, a sealing will occur at locations 30 and 32 (FIG. 2) and a space Y (FIG. 3) will exist between the roller and the adjacent surface 34 of crushable porous material 28 intermediate locations 30 and 32.

In operation, fluid will be trapped within crushable porous material 28 and between the roller and circular wall 34 of crushable porous material 28. Under low loads on the roller by rotor 12, the fluid located in the material 28 and space Y will have a relatively low viscosity thereby allowing it to be replenished by surface film on the rotating roller. As the force on the roller is increased by the rotor, the viscosity of the fluid trapped in space Y will increase exponentially in accordance with the exerted force. Since the viscosity of the trapped fluid increases, its lubricational characteristics will also increase thereby providing an improved bearing support for the roller within the respective pocket. Additionally, it has been found that wear producing particles in the fluid are effectively excluded from entering the space Y by the edge sealing condition. This differs from the open edge condition that is necessary for conventional hydrodynamic lubrication.

It is important to note that the roller must have an "interference" fit with the pocket, i.e., the radius of each roller must be greater than or equal to R-X of the respective pocket. It is possible to crush material 28 at points 30 and 32 to the point where contact is almost made between the roller and stator 10. However, it is desirable to maintain a certain amount of material 28 between the roller and the stator.

Further, it is important that material 28 be both crushable, in order to allow for radially outwardly movement of the rollers into the respective pockets, and porous, in order to provide reservoirs for the fluid trapped between the rollers and the respective walls 20. This crushable porous material allows for the increase in viscosity of the fluid trapped intermediate locations 30 and 32 between the rollers and respective pockets. It is this increase in viscosity which ensures proper sealing and longevity of applicant's device.

It should further be appreciated that it is necessary to have the average diameter of the rotor interfere with the tangent circle of the stator-roller as described. It is this interference which insures radially outward movement of the rollers into the pockets and proper sealing between the rotor teeth and the rollers (i.e., stator teeth 14.)

Other crushable porous coatings may include those that are applied by spray using relatively high ratios of solids to liquids or those that result in partial drying of a mist before it reaches the surface. In these coatings a distinct pigment particle or aggregate of the pigment particles form a surface layer that preferably consists of nearly spherical particles adhering to the impervious wall 20. Suitable pigments include molybdenum disulfide, graphite, bearing metals such as bronze, tin, lead and babbitts and insoluble mineral pigments such as the oxides or iron, titanium and tin. Further, the coating may be formed by spraying molten droplets of bearing metals at the minimum temperature of fluidity. Also, electroplating under controlled conditions of relatively high current density which produces a porous deposit may be used for forming the coating. Slowly formed crystalline metal surfaces are also contemplated for the coating.

After a period of use it is possible that material 28 will take a permanent set at locations 30 and 32. Such a set is acceptable since at this point in use the roller will have formed the material 28 to the shape of the roller thereby insuring the formation of a seal at locations 30 and 32. The seals will retard the flow of fluid from space Y thereby ensuring that the outward radial movement of the roller will cause an increase in the pressure of the fluid in space Y and a corresponding increase in the viscosity of the fluid.

For purposes of this application the definition of the tangent circle of the stator-roller assembly is defined in the following manner. In the illustrated embodiment the material 28 is placed on the wall 20 of each pocket. The rollers are thereafter located in each pocket at a position in which contact is made with material 28 but crushing of the material does not occur. This will result in the center of the roller being located radially inwardly from the center of the pocket if the radius of the roller is greater than R-X or at the center of the pocket if the radius of the roller is R-X. The distance from the center of the roller to the center of the stator is then determined and the radius of the roller is subtracted from this determined distance. The remaining distance is equal to the radius of the tangent circle of the stator-roller assembly, i.e., the circle that will be formed by a radius rotated about the center of the stator and having a length equal to the remaining distance.

It should be appreciated that the end faces of the stator-rotor assembly are enclosed, when placed in a fluid device, by a pair of radially extending plates 36 and 38 as illustrated in FIG. 5. These plates prevent the flow of fluid axially out of the respective chambers 24A to 24G and out of the space "Y". Such axial sealing is well known in the art as is illustrated, e.g., in U.S. Pat. Nos. 3,899,270 and 3,905,728.

What is claimed is:

1. A pair of relatively movable members for use with a fluid comprising:

A. an externally toothed member; and

B. an internally toothed member cooperating in gear relationship with the externally toothed member and having at least one more tooth than the externally toothed member, the internally toothed member including 1. an annular inwardly facing peripheral wall,
2. a plurality of circumferentially spaced pockets opening radially inwardly into the inwardly facing peripheral wall, the wall of each pocket being defined in part by a pair of spaced arcuate surfaces on the internally toothed member,
3. a cylindrical roller in each of the pockets forming the teeth of the internally toothed member, each of the rollers being in contact with the respective pair of arcuate surfaces, to form a seal which will substantially restrict the flow of fluid between the roller and the arcuate surfaces when a force is exerted on the roller in a radially outwardly direction, the arcuate surfaces being made of a material that is resilient relative to the material of the respective rollers to allow for radially outwardly movement of the rollers in their respective pockets,
4. an enclosed space for trapping fluid in each of the pockets intermediate the arcuate surfaces, the space being defined in part by the wall of the pocket and the roller and having a relatively small volume which would be substantially decreased in the absence of trapped fluid with slight movement of the roller in the radially outwardly direction to cause an increase in the pressure of the trapped fluid within the enclosed space upon such radially outwardly roller movement, and
5. a tangent circle that interferes with the average diameter of the externally toothed member whereby rotation of the externally toothed member relative to the internally toothed member will create a radially outwardly directed force on each of the rollers tending to move each of the rollers radially outwardly in the respective pocket.

2. A pair of members according to claim 1 wherein the resilient material is a crushable material.

3. A pair of members according to claim 1 further comprising a porous material on the wall of each of the pockets intermediate the arcuate surfaces.

4. A pair of relatively movable members for use with a fluid comprising:

A. an externally toothed member; and

B. an internally toothed member cooperating in gear relationship with the externally toothed member and having an annular inwardly facing peripheral wall and at least one more tooth than the externally toothed member, the internally toothed member including 1. a plurality of circumferentially spaced pockets opening inwardly into the inwardly facing peripheral wall, each of the pockets having a wall formed by a portion of the circumference of a cylinder having a radius of R units,
2. a crushable porous material attached to the walls of each of the pockets and having a non-crushed thickness of X units, and
3. a cylindrical roller in each of the pockets, the rollers forming the teeth of the internally toothed member, each roller has a radius that is equal to or greater than R-X units, and is in contact at spaced locations with the crushable porous material whereby fluid will be trapped between the roller and the pocket wall intermediate the contact locations.

5. A pair of members according to claim 4 further comprising means to prevent the axial flow of fluid out of the space between the roller and the pocket wall, said means including a pair of axially spaced members in sealing engagement with the internally toothed member.

6. A pair of members according to claim 5 wherein the wall of each pocket extends throughout an arc that is equal to or greater than 150° and equal to or less than 185°.

7. A pair of members according to claim 5 wherein:

C. the units are inches; and

D. the thickness X is 0.0016 units plus or minus 0.0015 units.

8. A pair of members according to claim 5 wherein the crushable porous material is chosen from the group consisting of iron manganese phosphate, molybdenum disulfide, graphite, a bearing metal, and an oxide of a metal.

9. A pair of members according to claim 5 wherein the radius of each roller is equal to or less than R units.

10. A pair of members according to claim 1 wherein the externally toothed member is of a size to ensure that the average diameter of the externally toothed member interferes with the tangent circle of the internally toothed member and roller assembly.

11. A pair of members according to claim 5 wherein:

C. the crushable porous material is attached to the wall of each of the pockets and extends in an arc at least to the location where each of the pockets opens into the inwardly facing peripheral wall; and D. the cylindrical roller in each of the pockets compresses the crushable porous material adjacent the inwardly facing peripheral wall.

12. A pair of members according to claim 11 wherein the radius of each roller is equal to or less than R units.

13. A pair of members according to claim 11 wherein:

E. the units are inches; and

F. the thickness X is 0.0016 units plus or minus 0.0015 units.

14. A pair of members according to claim 11 wherein the wall of each pocket extends throughout an arc that is equal to or greater than 150° and equal to or less than 185°.

15. A pair of members according to claim 11 wherein the crushable porous material is chosen from the group consisting of iron manganese phosphate, molybdenum disulfide, graphite, a bearing metal, and an oxide of a metal.

* * * * *